US005964360A

United States Patent [19]

Hwang

[11] Patent Number: 5,964,360

[45] Date of Patent: Oct. 12, 1999

[54] RACK FOR OFFICE MACHINES

[75] Inventor: James Hwang, Taipei, Taiwan

[73] Assignee: Kenmark Industrial Co., Ltd., Taipei Taiwan, China

[21] Appl. No.: 09/172,202

[22] Filed: Oct. 14, 1998

[51] Int. Cl.[6] ..... A47B 43/00

[52] U.S. Cl. ..... 211/186; 211/188

[58] Field of Search ..... 211/186, 188, 211/126.2, 133.1; 108/156, 190, 186, 158.11, 158; 403/299, 260, 258; 248/165, 159; 464/153, 154; 285/148.23

[56] References Cited

U.S. PATENT DOCUMENTS

| | | | |
|---|---|---|---|
| 167,118 | 8/1875 | Pritchett | 403/260 X |
| 675,320 | 5/1901 | Boyne | 285/148.23 X |
| 703,657 | 7/1902 | Horn | 285/148.23 |
| 2,521,355 | 9/1950 | Ford | 248/159 |
| 2,529,649 | 11/1950 | Coplen | 211/188 X |
| 2,583,300 | 1/1952 | Marcussen | 285/148.23 X |
| 2,607,648 | 8/1952 | Metclaf | 108/158 |
| 2,730,419 | 1/1956 | Watrous et al. | 108/156 |
| 2,934,214 | 4/1960 | Mogulescu et al. | 211/133.1 X |
| 3,684,285 | 8/1972 | Kane | 211/188 X |
| 4,359,947 | 11/1982 | Marshack | 211/186 X |
| 5,218,914 | 6/1993 | Dickinson | 108/186 X |
| 5,338,070 | 8/1994 | Horikawa et al. | 285/148.23 X |
| 5,722,544 | 3/1998 | Williams | 211/188 |

*Primary Examiner*—Daniel P. Stodola
*Assistant Examiner*—Erica B. Harris
*Attorney, Agent, or Firm*—Bacon & Thomas, PLLC

[57] ABSTRACT

A rack for office machines comprised of a bottom plate, an intermediate plate, a plurality of feet, seals and rods, wherein, the bottom plate and the intermediate plate are provided thereon with a plurality of holes. Each foot is provided on one end thereof with an internal thread. Each seal has a flanged top and an opposite end with an external thread. Each rod is provided on one end thereof with an internal thread and on the other end thereof with an external thread. Each end with an internal thread of the foot is inserted into one hole on the bottom plate, while the end with an internal thread of the foot is threadedly engaged with the end of the rod with an external thread. The other end of the rod with an internal thread is inserted into a hole on the intermediate plate. The end with an external thread of a seal is threadedly inserted into the end with an internal thread of the first mentioned rod. In this way, a rack for office machines is constructed, wherein, the bottom plate and the intermediate plate can be connected in suiting convenient use of one or more office machines.

5 Claims, 5 Drawing Sheets

RACK FOR OFFICE MACHINES

BACKGROUND OF THE INVENTION

1. Field of the Invention

The present invention is related to a rack for office machines. Such rack for office machines is composed of a plurality of rods of different lengths, a plurality of feet and seals insertably mounted respectively on a bottom plate and a plurality of intermediate plates. These members are combined at will to construct the rack.

2. Description of the Prior Art

It is very popular to use office machines in a modern office. Space in such modern offices changes a lot by entering of such office machines. With a view on managing, to integrate or arrange office machines of different usage efficiently in an identical location should be the best mode for increasing working efficiency. Therefore, multifunctional racks for office machines in the market are specifically welcome.

Racks for office machines in the market nowadays are mostly provided with the function of gathering the office machines for management. However, such racks are mostly sold in a certain combination, the function they provide is certain and unchangeable, a user can only use such a rack for some office machines that the rack more likely suits concerning their sizes and types. Hence there is often uneasy operation of the office machines and the case that viewing is obstructed. These are contrary to the original purpose of using the rack.

SUMMARY OF THE INVENTION

The reason that such racks mostly do not fit the sizes of office machines and therefore do not provide suitable operation spaces for the latter is resided in that, such racks lack of a factor of flexible combination. In view of this, the present invention provides a rack adapted to be freely combined and changed to a variety of forms. The present invention is comprised of a bottom plate, a plurality of intermediate plates, feet, rods and seals. A plurality of holes are provided at appropriate locations on the bottom plate and intermediate plates. The feet, rods and seals are provided respectively with ends with internal or external threads. These ends are inserted respectively into the holes on the bottom plate and intermediate plates to pile up the bottom plate and intermediate plates in layers. By different lengths of the rods, spaces of different height can be created on the rack. The intermediate plates can have various suitable shapes to form most suitable shelving spaces. With this arrangement, the present invention can solve the problem that conventional racks for office machines are mostly unchangeable in space utilizing.

The present invention will be apparent after reading the detailed description of the preferred embodiment thereof in reference to the accompanying drawings.

DETAILED DESCRIPTION OF THE PREFERRED EMBODIMENT

Figure 1:
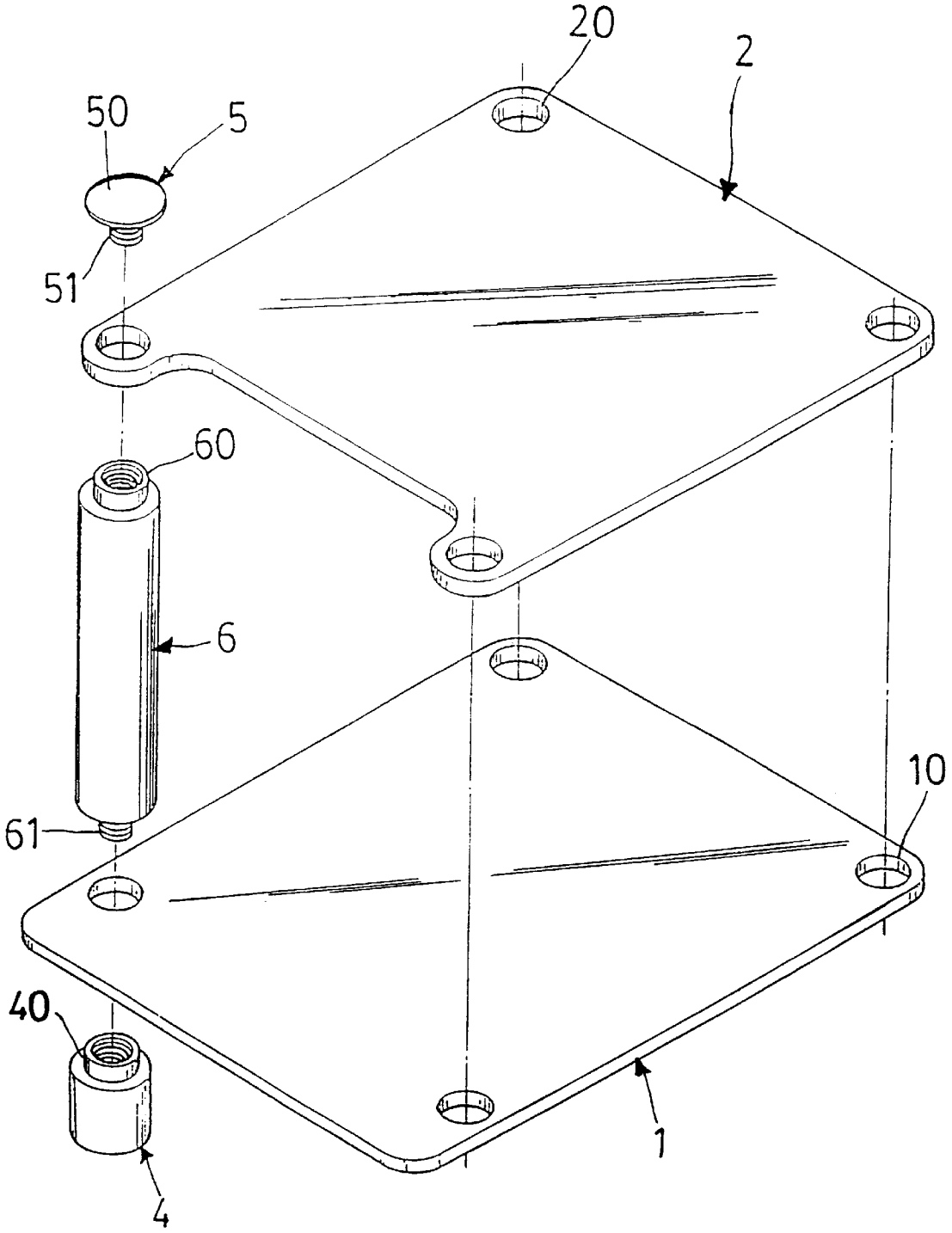
FIG. 1 is a perspective analytic view of the present invention.

Referring to FIG. 1, the present invention is comprised of a bottom plate 1, a plurality of intermediate plates 2, feet 4, seals 5 and rods 6. Wherein, the bottom plate 1 and the intermediate plates 2 are provided at appropriate locations thereon with plurality of holes 10, 20. Each foot 4 is provided on one end 40 thereof with an internal thread. Each seal 5 has a flanged top 50 and an opposite end 51 with an external thread. Each rod 6 is provided on one end 60 thereof with an internal thread and on the other end 61 thereof with an external thread.

Figure 2:
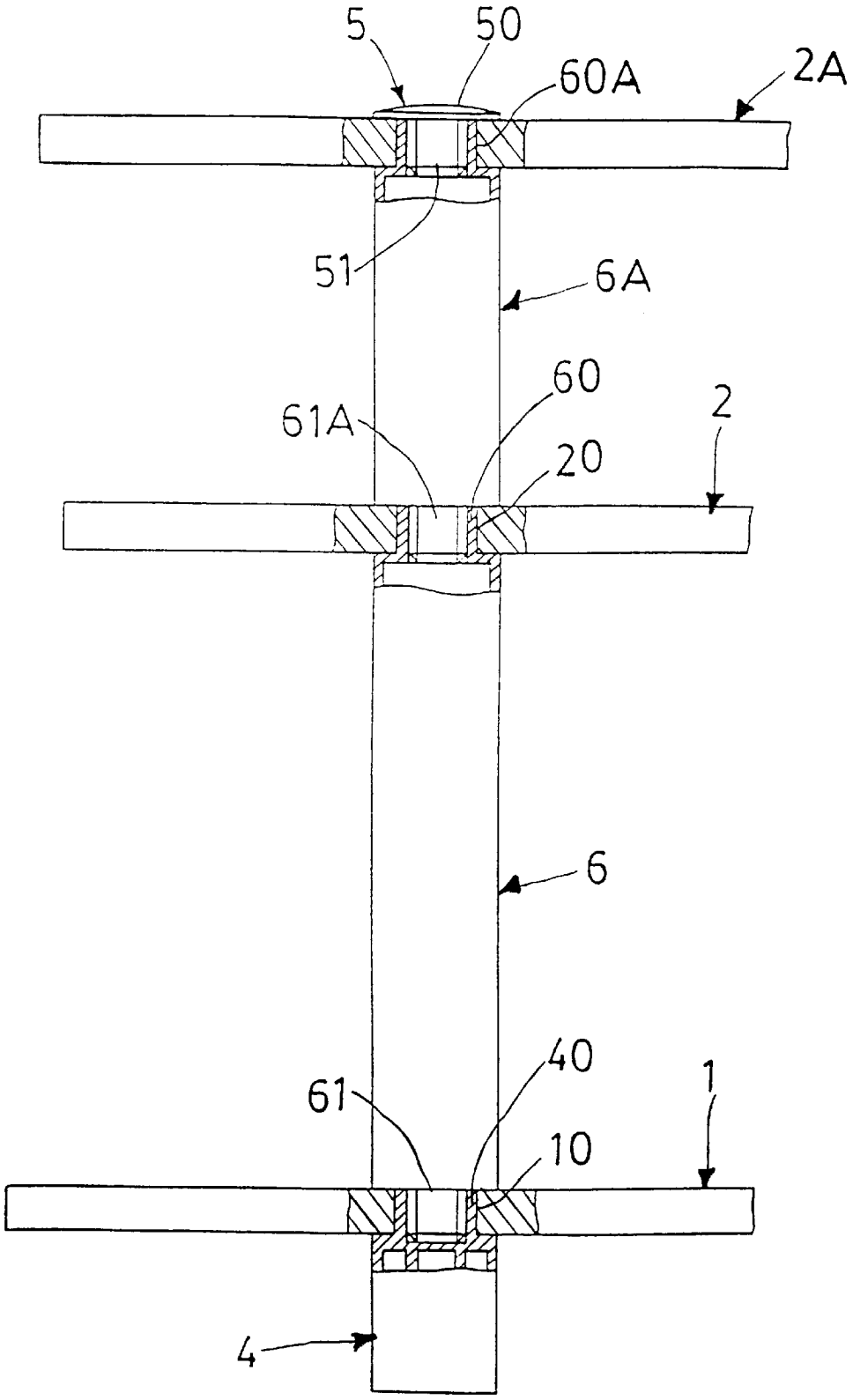
FIG. 2 is a sectional view showing the present invention after assembling.

Referring to FIG. 2, the rods 6 of the present invention can be of various lengths optionally. As depicted in the drawing, the mode of combination of the present invention is in the way below: The ends 40 with internal threads of the feet 4 are each inserted into a hole 10 on the bottom plate 1. Then one of the rods 6 with suitable length is selected to have its end 61 with an external thread engaged with the end 40 with an internal thread of the one of the feet 4. The other end 60 of the rod 6 with the internal thread is inserted into the hole 20 on one of the intermediate plates 2. In addition to the above stated steps and in constructing a rack with multiple layers, an end 61A of another rod 6A of suitable length and with an external thread is threadedly engaged with the internal thread of the above stated end 60 of each rod 6. And lastly, the ends 51 with external threads of a plurality of seals 5 are respectively thradedly inserted into a plurality of ends 60A having internal threads of the rods 6A in the holes of the uppermost intermediate plate 2A. Then the holes are sealed with the flanged tops 50 of the seals 5.

Figure 3:
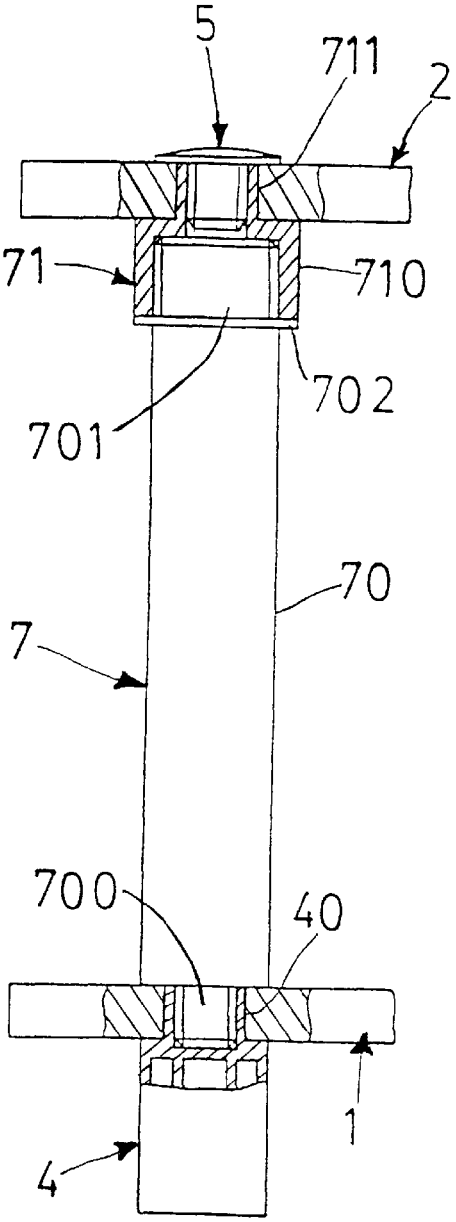
FIG. 3 is a sectional view showing the structure of another embodiment of the present invention.

Referring to FIG. 3 showing the structure of another embodiment of the present invention, wherein, a plurality of rods 7 are composed of several separated members. As shown in the drawing, each rod 7 is provided with a main shank 70 and a cap 71. Wherein, The main shank 70 is provided with two ends 700, 701 with external threads of different diameters. The lower portion of the end 701 with the external thread of the larger diameter adjoins a flange 702. The cap 71 is provided with two internal threads 710, 711 in two stepped parts thereof. The end 700 with an external thread of the rod 7, is similarly threadedly inserted into end 40 of a foot 4, which has an internal thread a bottom plate 1 is assembled to an intermediate plate 2. While the other end 701 with an external thread of the larger diameter is threadedly engaged with the internal threads 710 having also a larger diameter on the cap 71. The rod 7 being threadedly engaged is then inserted with its internal thread 711 having a smaller diameter into a hole on the intermediate plate 2. A seal 5 is screwed in the internal thread 711 having a smaller diameter onto the cap 71. Such rod 7 is for the purpose of utilizing the main shank 70 being of the various ones with different diameters and the cap 71 thereof to create a solid rod 7, and to render the rack composed of a plurality of rods 7 to have a solid visual effect.

Figure 4:
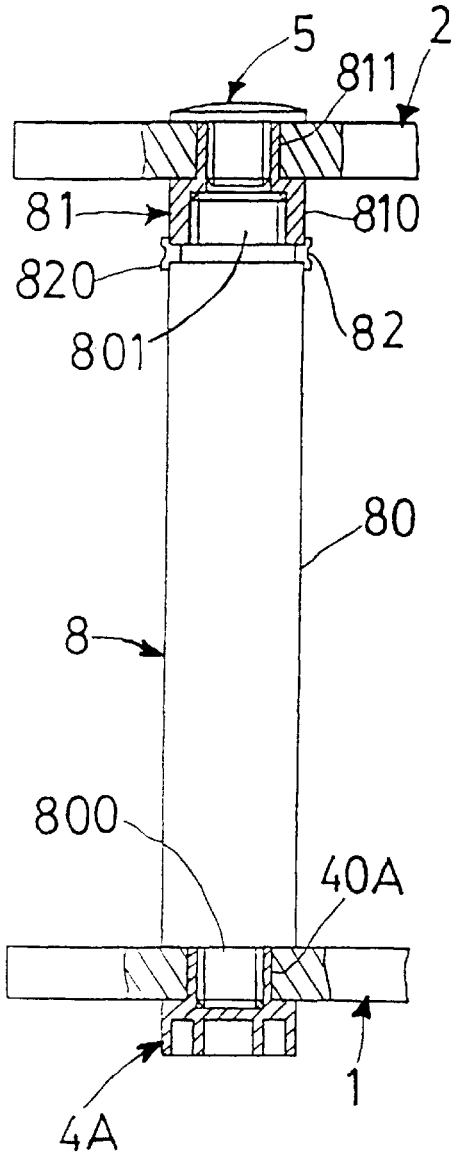
FIG. 4 is a sectional view showing the structure of a further embodiment of the present invention.

Referring to FIG. 4 showing the structure of a further embodiment of present invention, wherein, a plurality of rods 8 are composed of a main shank 80, a cap 81 and a collar 82. The main shank 80 is also provided with ends 800, 801 with external threads of larger and smaller diameters respectively. The cap 81 is also provided with two internal threads 810, 811 in two stepped parts thereof. The collar 82 has a peripheral rim 820 protruding upright upwardly and downwardly. Such rod 8 similarly has its end 800 with a smaller external thread threadedly inserted into the end 40A with an internal thread of a foot 4A. While the collar 82 is first inserted into end 801 with a larger external thread of the main shank 80, then the end 801 is threadedly engaged with the larger internal threads 810 on the cap 81. The internal thread 811 having a smaller diameter of the cap 81 is inserted into a hole on the intermediate plate 2. A seal 5 is screwed in the internal thread 811 having the smaller diameter. Such rod 8 is for the purpose to solve the problems as shown in FIG. 3, wherein, the main shank 70 and cap 71 of the rod 7 leave a seam between the cap 71 and the flange 702 of the main shank 70 after threaded engaging thereof. The seam is obscured with the thicker portions 820 on both ends of the collar 82.

Figure 5:
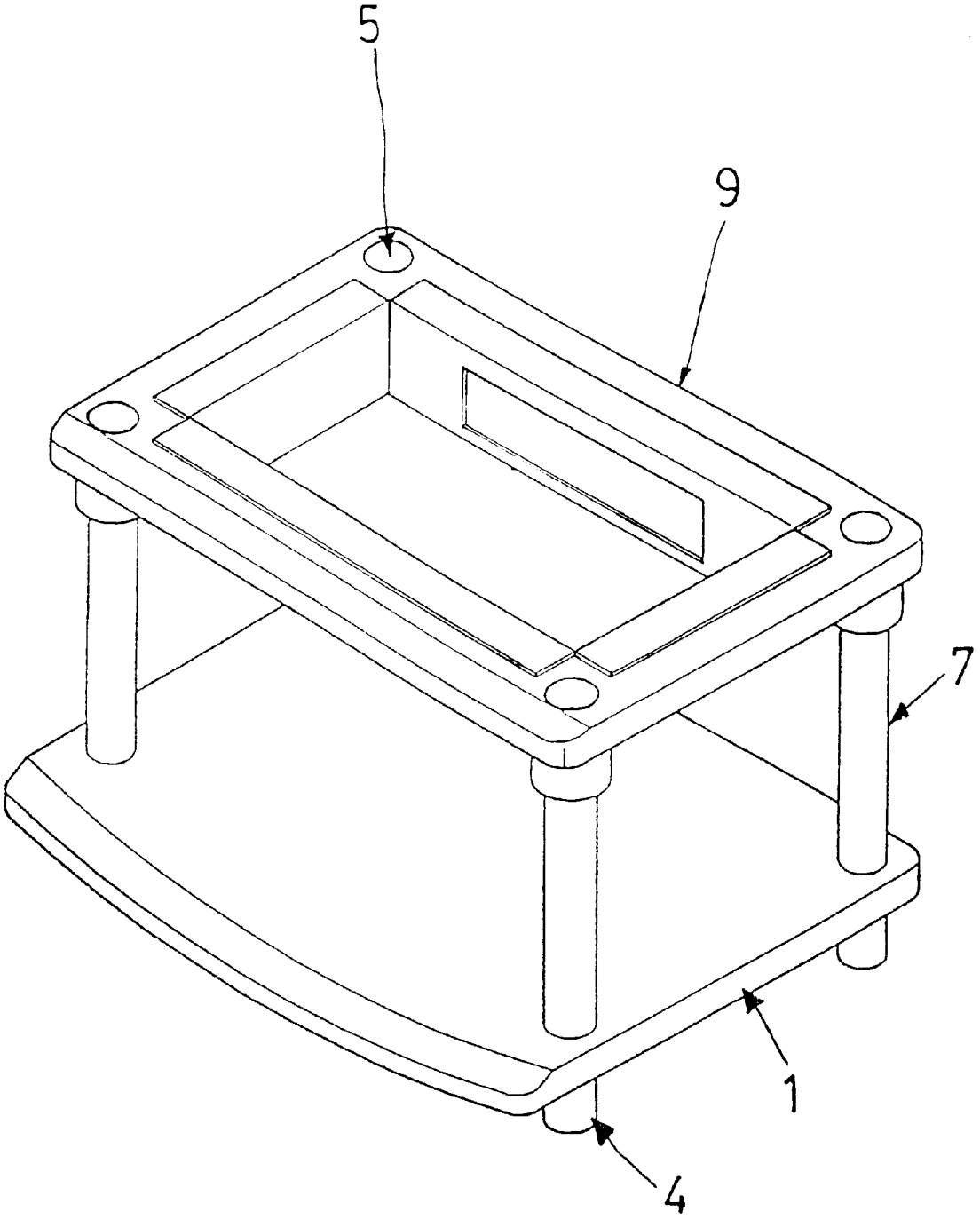
FIG. 5 is a perspective analytic view showing practicing of the present invention.
Figure 6:
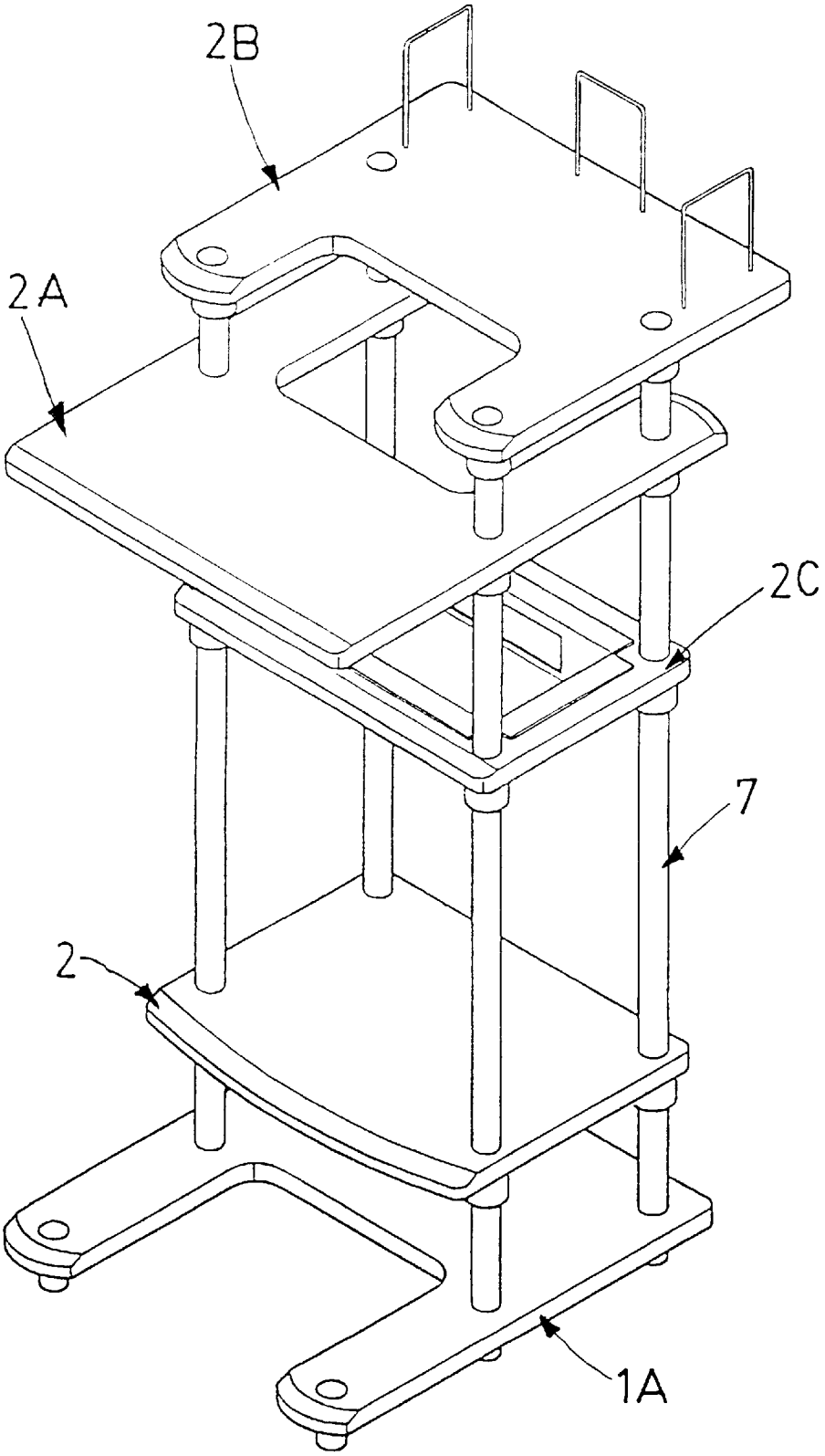
FIG. 6 is a perspective analytic view showing further practicing of the present invention.

Referring to FIGS. 5 and 6, the present invention can form any type of rack suiting any type of office machine by combination of rods of various types and bottom plate as well as intermediate plates of various shapes. As is depicted in FIG. 5, an elementary rack for an office machine is combined by a bottom plate 1, a frame 9 having the same function as an intermediate plate, a plurality of feet 4, seals 5 and rods 7. FIG. 6 shows a rack constructed by taking the rack of FIG. 5 as a basic structure and suiting various office machines used together on the rack. The rack is combined by a plurality of bottom plates 1 with various shapes, a plurality of intermediate plates 2A, 2B, 2C, and a plurality of feet 4, seals 5 and rods 7 of various lengths.

In conclusion, the present invention provides a rack for office machines. The device can get the object of flexible combination and abundant variation in suiting various requirement of usage. The structure stated above is only for illustrating a preferred embodiment of the present invention, and not for giving any limitation to the scope of the present invention. It will be apparent to those skilled in this art that various modifications or changes can be made to the elements of the present invention without departing from the spirit, scope and characteristic of this invention. Accordingly, all such modifications and changes also fall within the scope of the appended claims and are intended to form part of this invention.

I claim:

1. A rack for office machines comprising a bottom plate, at least one intermediate plate and a plurality of feet, seals and rods, respectively, wherein, said bottom plate is provided thereon with a plurality of holes of a first diameter;

said at least one intermediate plate is also provided thereon with a plurality of holes of a second diameter;

each of said feet is provided on one end thereof with an internal thread, said one end with an internal thread of each of said feet having an outer diameter corresponding to the first diameter which is smaller than a diameter of the remainder of each of said feet;

each of said seals has a flanged top and an opposite end with an external thread;

each of said rods having a predetermined diameter and reduced diameters on each end, each said rod is provided on one end thereof with an external thread and on the other end thereof with an internal thread, said other end with an internal thread of each of said rods having an outer diameter corresponding to the second diameter which is smaller than the predetermined diameter of each of said rods;

wherein each said end with an internal thread of said foot is inserted into one of said holes on said bottom plate, one of said rods with suitable length having its said end with an external thread engaged with said end with an internal thread of said foot; said other end of said rod with an internal thread is inserted into one of said holes on one of said at least one intermediate plate; said end with an external thread of one of said seals being threadedly engaged into said end with an internal thread of said rod.

2. A rack for office machines as in claim 1, wherein, said end with an internal thread of each of said rods is threadedly engaged with an end of another rod with an external thread, then said end of said another rod is inserted into a hole on another intermediate plate.

3. A rack for office machines comprising a bottom plate, at least one intermediate plate and a plurality of feet, seals and rods, respectively, wherein, said bottom plate is provided thereon with a plurality of holes of a first diameter;

said at least one intermediate plate is also provided thereon with a plurality of holes of a second diameter;

each of said feet is provided on one end thereof with an internal thread, said one end with an internal thread of each of said feet having an outer diameter corresponding to the first diameter which is smaller than a diameter of the remainder of each of said feet, each of said seals has a flanged top and an opposite end with an external thread;

each of said rods having a predetermined diameter and reduced diameters on each end, each said rod is comprised of a main shank and a cap, said main shank is provided with one end with an external thread of a larger diameter and another end with an external thread of a smaller diameter a lower portion of the end with a larger diameter, adjacent the predetermined diameter of the rod, adjoining a flange; said cap is provided with two internal threads in two stepped parts, an end of said cap with internal threads having a smaller diameter has an outer diameter corresponding to the second diameter which is smaller than the predetermined diameter of said main shank;

wherein each said end with an internal thread of said foot is inserted into one of said holes on said bottom plate, one said main shank with suitable length having its said end with an external thread of a smaller diameter engaged with said end with an internal thread of said foot; said end with an external thread of the larger diameter of said main shank is threadedly engaged with one of said internal threads having also a larger diameter of said cap said end of said cap with internal threads having a smaller diameter is inserted into one of said holes on one of said at least one intermediate plate; said end with an external thread of one of said seals being threadedly engaged into said end of said cap with internal threads having a smaller diameter.

4. A rack for office machines as in claim 3, wherein, a collar is provided at the junction of said main shank and said cap, said collar has a peripheral rim protruding upright upwardly and downwardly.

5. A rack for office machines as in claim 1 or 3, wherein, said rods have various lengths.

* * * * *